United States Patent [19]

Jacquel et al.

[11] 4,444,363

[45] Apr. 24, 1984

[54] DEVICE FOR DRIVING A FLEXIBLE PROTECTION WEB ROLLED UP ON A SHAFT

[75] Inventors: Dominique Jacquel, Marnaz; Louis Plumer, Caen, both of France; Henri Giust, Gaggiano, Italy

[73] Assignee: Somfy, Cluses, France

[21] Appl. No.: 356,779

[22] Filed: Mar. 10, 1982

[30] Foreign Application Priority Data

Mar. 24, 1981 [FR] France ..... 81 05821

[51] Int. Cl.[3] ..... B65H 17/02

[52] U.S. Cl. ..... 242/67.4; 242/75.44; 318/7

[58] Field of Search ..... 242/67.1, 67.4, 75.4–75.47, 242/203, 204, 208; 318/6, 7, 612, 87

[56] References Cited

U.S. PATENT DOCUMENTS 2,806,658 9/1957 Truesdale ..... 242/204

3,117,262 1/1964 Mullin ..... 318/7

*Primary Examiner*—Leonard D. Christian

*Attorney, Agent, or Firm*—Darby & Darby

[57] ABSTRACT

This invention relates to a device for driving a flexible protection element rolled up on a winding shaft, the free end of the element being connected through one or a plurality of flexible bonds to a winding drum. The winding drums and the winding shaft are coupled through reversible reduction gears to corresponding electric motors and to a pair of electromagnetic brakes of the type operating by current deficiency. The first motor is adapted to rotate in a first direction for rolling up the flexible bonds. The second motor is adapted to rotate in a direction opposite to that of the first motor for rolling up the flexible protection element. Electrical or electronic means are provided for actuating anyone of the two motors and simultaneously energizing the two brakes. This invention is applicable notably for driving protection tents, canvasses and the like in glass-houses, greenhouses and the like.

5 Claims, 6 Drawing Figures

DEVICE FOR DRIVING A FLEXIBLE PROTECTION WEB ROLLED UP ON A SHAFT

BACKGROUND OF THE INVENTION

This invention relates to devices for driving a flexible protection web adapted to be rolled and unrolled on and from a winding shaft. The free end of the web is connected through the medium of at least one flexible bond to the outer periphery of a winding drum.

In known devices of this character, for example the one described and illustrated in the French Patent No. 2,329,838, the winding drum is coaxial to, and rotatably solid with, the winding shaft. The flexible bonds connecting the end of the flexible web to the winding drum are guided by pulleys mounted for loose rotation on spring-loaded supports disposed on the side from which the flexible web is to be unrolled. The winding drum is so designed that its outer diameter increases as the flexible web is rolled up, so that the springs of the pulley carriers are gradually stressed and the flexible web is kept in its stretched condition throughout the unrolling thereof.

However, this device is objectionable in that its structure is relatively complicated and the flexible bonds disposed on either side of the flexible web during the rolling up thereof are cumbersome and rather unsightly. Moreover, fitting the guide pulleys and the flexible bonds constitutes a relatively long a tedious operation for a proper rolling up and off of the web.

SUMMARY OF THE INVENTION

The winding device according to the present invention comprises a winding shaft and one or a plurality of winding drums rotatably connected to two electric drive motors through two reversible reduction gears and two electro-magnetic brakes of the type operating by current deficiency. The first motor is designed for rotation in the direction corresponding to the winding up of the flexible bonds on the winding drum or drums, respectively, and the second motor is adapted to rotate in the direction to roll up the flexible web on the winding shaft. Electrical or electronic control means are provided for energizing anyone of said electric motors and simultaneously actuating the two electromagnetic brakes.

With the present invention it is possible to provide a driving mechanism having a relatively simple structure and a better appearance than the above-mentioned prior art, and which in addition can be fitted simply and rapidly while affording a very satisfactory stretching of the flexible web in its unrolled condition.

A detailed description of the driving device and control means of this invention will now be made with reference to the accompanying drawings illustrating diagrammatically preferred form of embodiment thereof.

THE DRAWINGS

DESCRIPTION OF THE PREFERRED EMBODIMENTS

Figure 1:
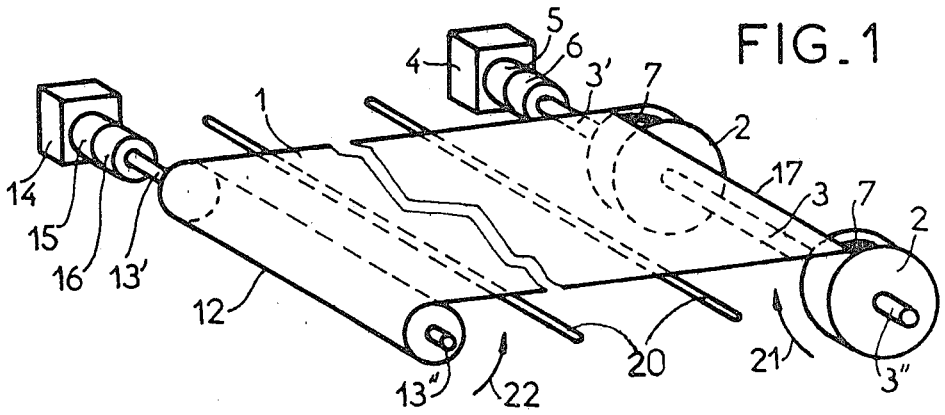
FIG. 1 is a diagrammatic perspective view showing a first form of embodiment of the driving device, the flexible web being shown in its unrolled condition.
Figure 3:
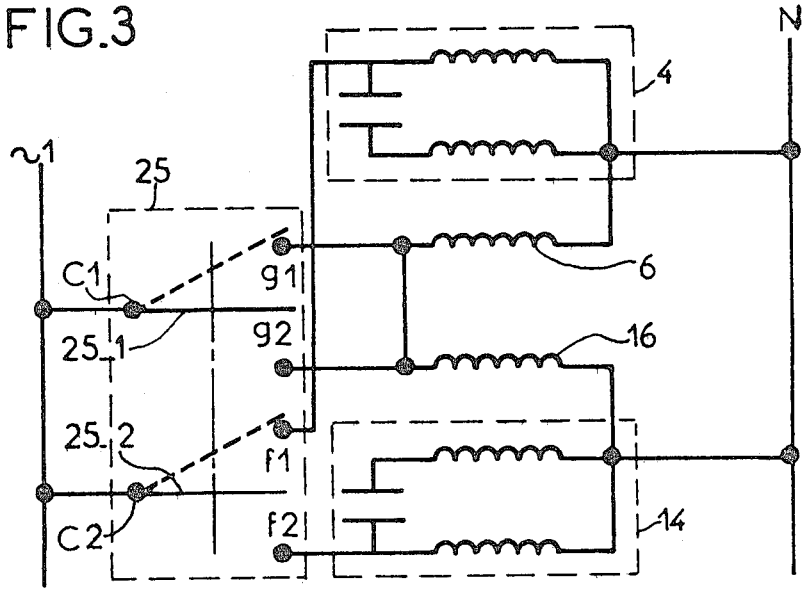
FIG. 3 illustrates the wiring diagram of the control circuit of the first form of embodiment.

As illustrated in FIGS. 1 and 3 of the drawings the driving device of the present invention comprises a flexible protection element 1 consisting for example of a relatively long canvas web which, when inoperative, is rolled up on a winding shaft 12.

The free end 17 of this web 1 is connected through flexible bonds 7 (which in this example are two in number) to the outer periphery of a pair of winding drums 2 rigid with a shaft 3 of which the first end 3' and the second end 3'' constitute the end trunnions of said drums, respectively. The first end 3' of shaft 3 is rotatably connected by means of a first reversible reduction gear 5 and a first electromagnetic brake 6 to a first external electric motor 4.

The winding shaft 12 consists for example of a tube supporting at its opposite ends trunnions 13',13'' respectively, acting as pivot means. One trunnion 13' is rotatably coupled through a second reversible reduction gear 15 and a second electromagnetic brake 16 to a second external electric motor 14.

Both electromagnetic brakes 6 and 16 operate according to the current deficiency method; in other words, when energized, they cause on the one hand the winding drum 2 to be interlocked with the first reduction gear 5, and on the other hand the winding shaft 12 to be interlocked with the second reduction gear 15; when said brakes are de-energized, these elements rotate independently of each other, respectively.

The first motor 4 is adapted to rotate in the direction of the arrow 21 so as to roll up the two flexible bonds 7 on their relevant winding drums 2. The second motor 14 is adapted to rotate in the direction of rotation 22, i.e. opposite the direction 21, so as to roll up the flexible web 1 on the winding shaft 12.

In the example illustrated in FIG. 1, the winding shaft 12 and the shafts 3' and 3'' of drums 2 are parallel to each other in a substantially horizontal plane. A pair of rigid supporting member 20 are provided at spaced intervals for supporting the flexible protection web 1 so as to constitute a sunshade, for example.

The wiring diagram of FIG. 3 illustrates the electrical circuitry provided for controlling to the two motors 4,14 and the two electromagnetic brakes 6 and 16. The electric control circuit comprises a two-way double-throw reversing switch 25 which, when inoperative, is in the intermediate position shown in FIG. 3. The common terminals C1,C2 of the reversing switch arms 25-1 and 25-2 are connected to one of the terminals (for instance ~ 1), of a current supply line. The motors 4 and 14 are connected on the one hand to terminals f1,f2 of the second two-way switch arm 25-2 and on the other hand to the neutral wire N of the supply line, respectively. The electromagnetic brake windings 6,16 are connected on the one hand to the terminals g1 and g2 of the first two-way switch arm 25-1 (which are interconnected) and on the other hand to the neutral wire N of the supply line.

Figure 2:
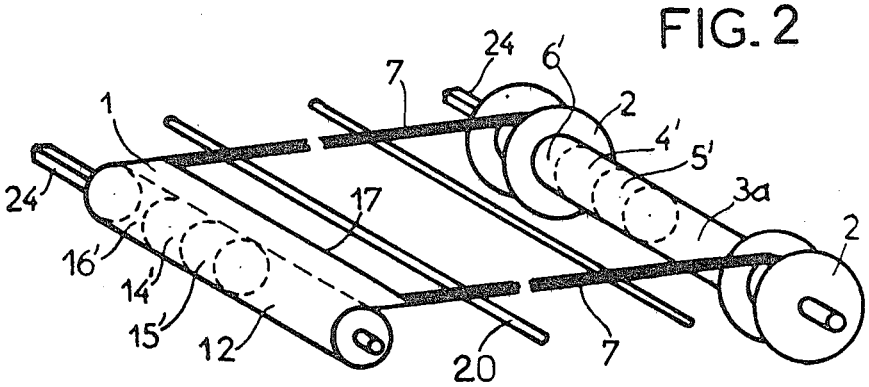
FIG. 2 is a view similar to FIG. 1 showing a modified form of embodiment with the flexible web in its rolled-up position.

In the rolled-up position the flexible protection web 1 is rolled up completely on the winding shaft 12, as shown diagrammatically in FIG. 2. To unroll the flexible web 1 the two-way doublethrow reversing switch 25 is moved in the direction shown in dash lines in FIG. 3, so that C1 and g1, and C2 and f1 are interconnected, respectively. Thus, the first motor 4 and the two electromagnetic brake windings 6 and 16 are energized, and the brakes 6, 16 are released. The first motor 4 drives via the first reduction gear 5 the winding drums 2 in the direction of the arrow 21, so that both flexible bonds 7 are rolled up on said drums and subsequently cause the flexible web 1 to be unrolled in turn while driving the second reversible gear 15 and the second motor 14. When the flexible protection web 1 has been unrolled completely (FIG. 1), the two-way reversing switch 25 is restored to its inoperative intermediate position, thus de-energizing the first motor 4. Then, the two-way double-throw reversing switch 25 is restored manually but during a short time period to the preceding position (g1-f1). The brief period of rotation of the first motor 4 is attended by a brief rotation of winding drums 2, however without allowing sufficient time to the second motor 14 for actually starting off. Thus, the flexible web 1 is properly stretched.

When the two-way double-throw reversing switch 25 is restored manually to its second position, the second motor 14 is energized together with the two electromagnetic brakes windings 6 and 16. Thus, the flexible web 1 is rolled up as shown by the arrow 22 on its winding shaft 12.

FIG. 2 illustrates a modified form of embodiment of the same invention in which tubular motors 4',14' are substituted for the external motors 4 and 14, the arrangement also comprising tubular reduction gears 5',15' and electromagnetic brakes 6',16' housed on the one hand within a tubular member 3*a* supporting the winding drums 2 and on the other hand within the tubular winding shaft 12, respectively. Each motor and reduction-gear assembly is anchored by means of a fixed-point section member 24 to the relevant fixed frame structure. The assembly operates like the one illustrated in FIG. 1.

Figure 4:
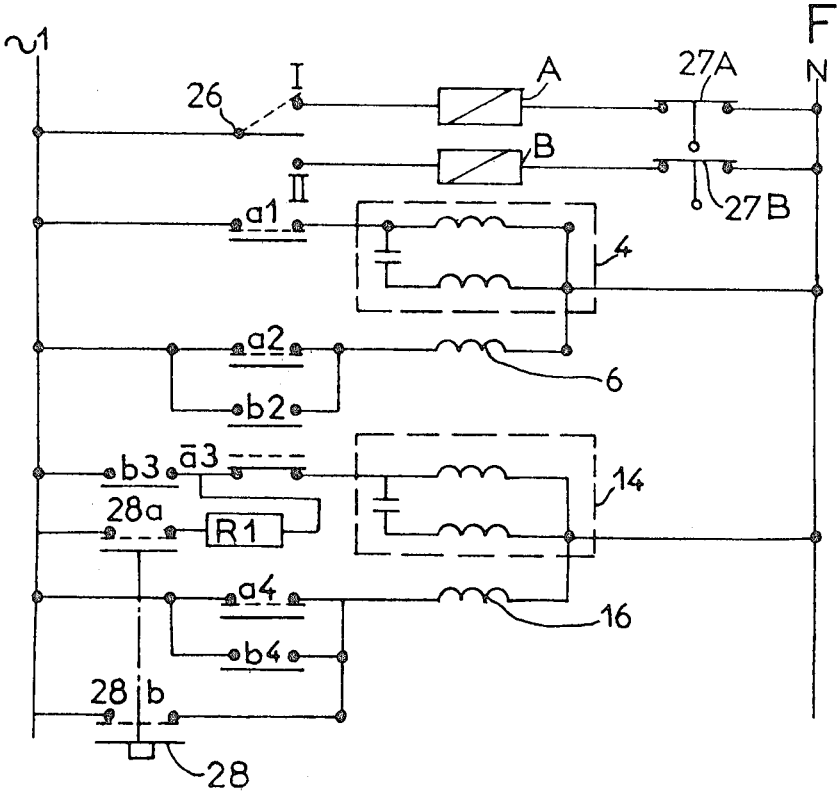
FIG. 4 is another wiring diagram concerning a second form of embodiment.

FIG. 4 shows a second form of embodiment of the electric circuitry for controlling the motors 4,14 (FIG. 1) or 4',14' (FIG. 2), which constitutes an improvement with respect to the first one (FIG. 3). A two-way single-throw reversing switch 26 having an intermediate inoperative position is adapted to control at will either a first relay A connected in series with a first automatic stop switch 27A, or a second relay B connected in series with a second automatic stop switch 27B. The first relay A controls switches a1, a2,a3 and a4. The second relay B controls switches b2,b3 and b4. Front switch a2 (open in the inoperative position) controls the energization of the first brake 6. Another front switch b2 (open in the inoperative position) is connected in parallel with a2. The second motor 14 is controlled by the normally closed switch a3 and by the normally open or front switch b3 in series with a3. The second brake 16 is controlled by the normally open front switch a4. A normally open two-pole push-button switch 28 comprises a first pair of contact studs 28*a* in series with a resistor R1 and switch a3, and a second pair of contact studs 28*b* in parallel with switches a4 and b4. The motors 4 and 15, as well as brakes 6 and 16, are de-energized. The flexible web 1 is for example rolled up completely, as shown in FIG. 2.

When switch 26 is moved to position I, relay A is energized and consequently contacts a1,a2 and a4 are closed and contact a3 is open (as shown in dash lines. Thus the first motor 4 and also the brakes 6 and 16 are energized, and the second motor 14 is de-energized. When the flexible web 1 is unrolled completely (FIG. 1) the automatic stop switch 27A opens and since relay A is no more energized, switches a1,a2,a3 and a4 resume their inoperative position. The first motor 4 and both brakes 6,16 are de-energized. Then, to stretch the web 1, it is only necessary to actuate manually and during a very short time the push button switch 28. The simultaneous closing of both pairs of contacts 28*a* and 28*b* causes energizing current to be fed to the second brake 16 and the second motor 14, the first brake 6 and first motor 4 remaining in their de-energized condition. The flexible web 1 is thus stretched. To prevent the exertion of an excessive stretching force on web 1, the voltage fed to the second motor 14 is weakened by resistor R1.

To roll up again the flexible web 1 on the winding shaft 2, the reversing switch 26 is set to position II. Thus, contacts b2,b3 are closed and brakes 6 and 16 are energized, together with the second motor 14. When the flexible web 1 is fully rolled up, the automatic stop switch 27B de-energizes relay B. Thus, contacts b2,b3 and b4 are opened. The second motor 14 and both brakes 6,16 are no more energized. The flexible bonds 7 may if desired be stretched by manually actuating the push-button switch 28 during a short time.

Of course, it would not constitute a departure from the scope of the present invention to dispense with the automatic stop switches 27A and 27B, and to control the energization of relays A and B only through the reversing switch 26.

Figure 5:
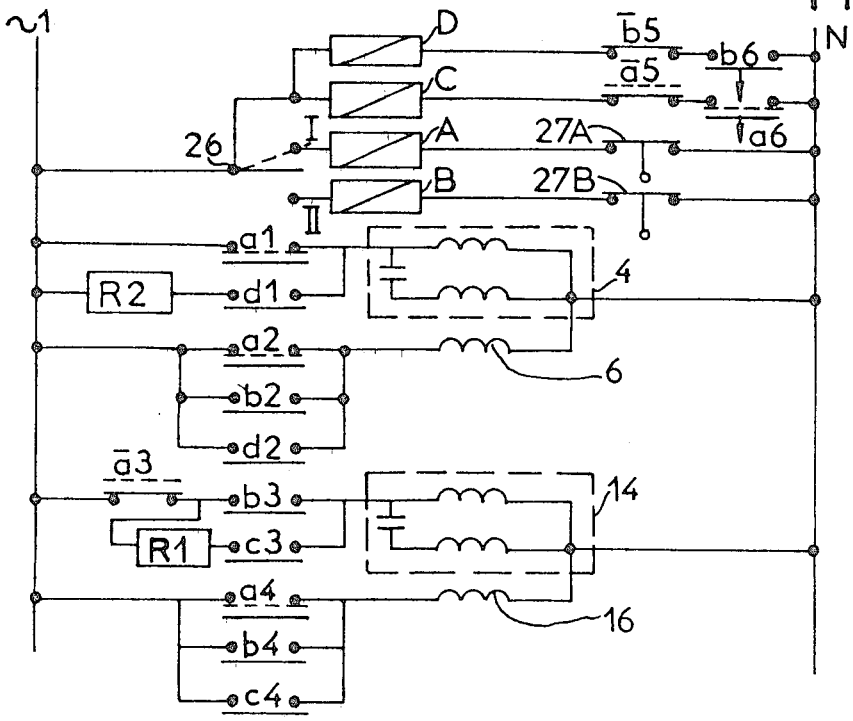
FIG. 5 is a further wiring diagram concerning a third form of embodiment.

FIG. 5 illustrates another improved electric control circuit in which the relay means A and B of the preceding form of embodiment (FIG. 4) actuate additional contacts, namely back contact a5, front contact a6, and back contact b5, front contact b6. In this circuit, a6 and b6 act as time-lag switches. Contacts b5 and b6 are series-connected and control a relay C. Contacts b5 and b6 are also series-connected and control another relay D. Relay C is adapted to actuate contacts c3 and c4, and relay D is adapted to actuate contacts d1 and d2. Front contact d1 is connected in parallel with a1 and in series with a resistor R2 similar to resistor R1 in the embodiment illustrated in FIG. 4. Front contact c3 is connected in series with resistor R1 and substituted for front contact 28*a* of FIG. 4. Front contact c4 is connected in parallel with front contacts a4 and b4, and substituted for front contact 28*b* of FIG. 4. All the other component elements of this circuit are identical with those of the preceding form of embodiment (FIG. 4).

When switch 26 is restored to its first position I, relay A actuates contacts a1,a2,a3 and a4 as in the case illustrated in FIG. 4. Moreover, this relay A opens contacts a5 and closes contacts a6, thus de-energizing relay C. Thus, the first motor 4 and both brakes 6 and 16 are energized. The subsequent opening of automatic stop switch 27A will discontinue their energization. At the same time, relay A releases contacts a5, which will thus close, and a6 which, being a time-lag contact, for example with the assistance of the dashpot device, remains closed during a short time period. During this short time period relay C is energized and closes contacts c3 and c4, thus causing the energization of the second motor 14 and second brake 16, respectively, while the first motor 4 and first brake 6 are de-energized. Thus, the flexible web 1 is stretched automatically.

When the reversing switch 26 is subsequently moved to position II, in a similar fashion, relay B actuates all b contacts and when contact 27B is opened the first motor 4 and first brake 6 are energized under the control of relay D, in order to stretch the flexible bonds 7. The role of resistor R2 is the same as that of resistor R1, that is, limiting the voltage supplied to the relevant motor.

In both control circuits described hereinabove with reference to FIGS. 4 and 5 of the drawings the function of back contact a3 is to prevent the two motors 4 and 14 from being energized simultaneously, for example in case of false manoeuvre.

Figure 6:
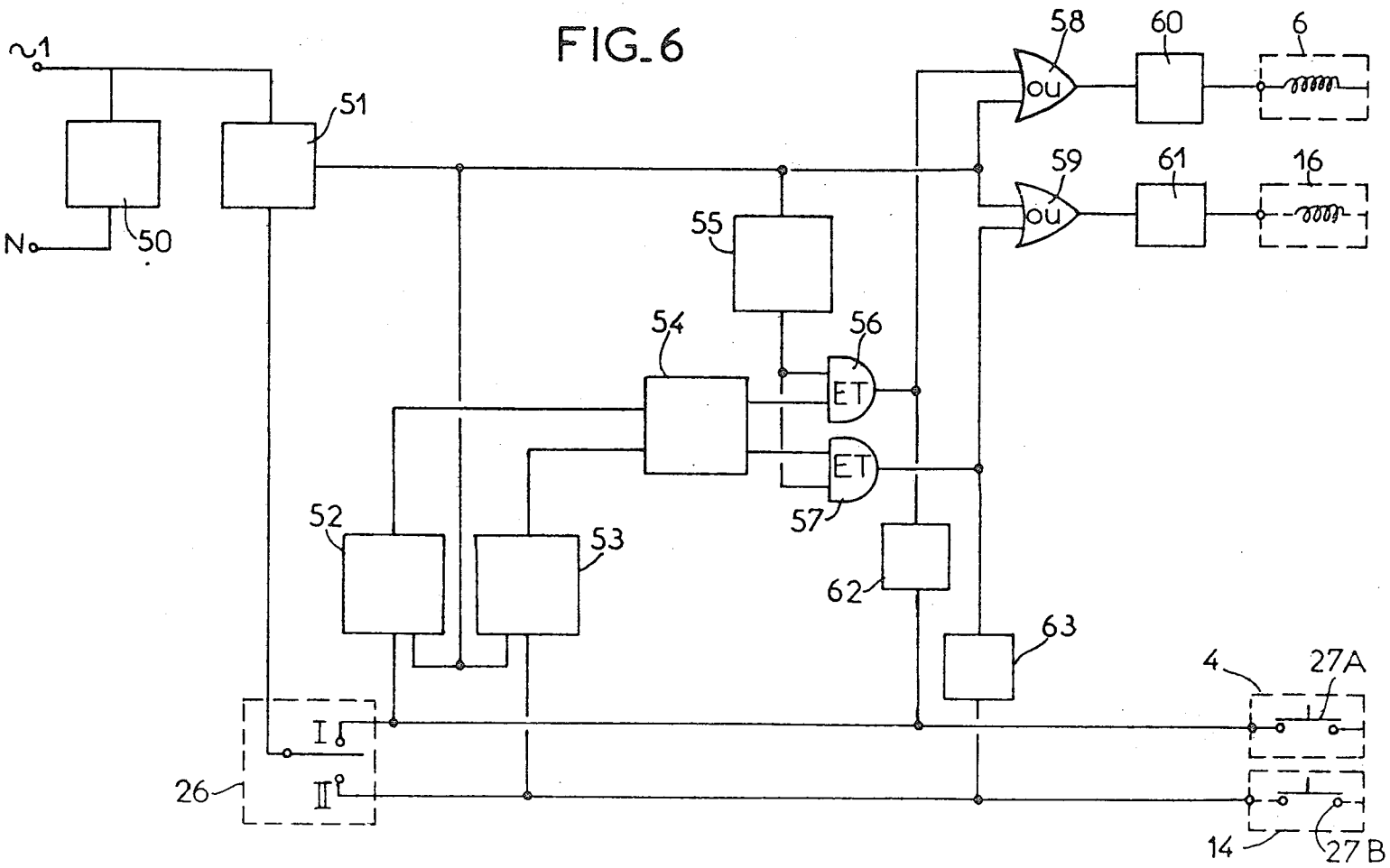
FIG. 6 is a wiring diagram concerning a fourth form of embodiment of the invention.

FIG. 6 illustrates a typical form of embodiment of an electronic control system according to the present invention. This control device comprises a current supply block 50 and a detection circuit 51. The input of supply block 50 are connected to the ~1 phase of to the neutral wire N of the mains, and the output of supply block 50 delivers a stabilized direct current (not shown in the drawings) for feeding all the circuits of the device. The input of circuit 51 for detecting the starting of motors 4 and 14 is connected to the ~1 phase and the output of circuit 51 is connected to a pair of OR gates 58 and 59, to one input of logic detection circuits 52 and 53, and to a time-lag device 55 consisting for example of a monostable circuit. The mains phase ~1 is also available at the output of circuit 51. This circuit 51 may for example consist of a transistor adapted to be saturated by the passage of the motor supply current through a resistor, so as to charge a capacitor at the stabilized supply voltage delivered by the supply block 50 and corresponding to said logic level 1.

A switch consisting of a reversing device 26 is normally open in its intermediate or inoperative position. It comprises two operative positions denoted I and II. The terminals corresponding to positions I and II are coupled to the inputs of logic circuits 52 and 53 for detecting the starting of motors 4 and 14, respectively, and to said motors 4 and 14, respectively, as shown. The two detection logic circuits 52 and 53 consist each, for example, of a transistor adapted on the one hand to become saturated when the mains phase ~1 is present at its input when switch 26 is closed, and on the other hand to be locked when the same switch is opened. The transistor output is coupled to an AND gate adapted to become operative by the action of the detection device 51 causing the rotation of any one of said motors 4 or 14. Both circuits 52 and 53 have their outputs coupled each to one input of a bistable circuit 54. The two outputs of this bistable circuit 54 are each coupled to one of the two inputs of two AND gates 56 and 57. Each AND gate 56, 57 has its second input coupled to the output of the time-lag device 55. The output of AND gate 56 is coupled on the one hand to one input of OR gate 58 and on the other hand to the input of a power member 53. The output of OR gate 58 is connected to another power member 60 and the output of OR gate 59 is connected to a further power member 61. The outputs of these power members 60 and 61 are connected to the windings of electromagnetic brakes 6 and 16, respectively. The outputs of power members 62 and 63 are connected to the motors 4 and 14 via automatic stop switches 27A and 27B.

When switch 26 is in its intermediate or inoperative position (FIG. 6), power members 60,61,62,63 are in such condition that the brakes 6,16 and motors 4,14 are de-energized, so that the brakes are caused to operate.

When the reversing switch 26 is moved to position I and the automatic stop switch 27A is open, the first motor 4 cannot be energized and the complete circuit remains inoperative. If switch 27A is closed, the motor 4 is energized through the circuit 51 detecting the starting thereof, via reversing switch 26. This circuit 51 detects the passage of supply current to the motor and delivers a logic signal energizing the power members 60 and 61 through the OR gates 58 and 59, and eventually energizes the windings of brakes 6 and 16. Simultaneously, the detection circuit 52 detects the energization of motor 4 and positions the outputs of bistable circuit 54, whereby gate 57 becomes operative and gate 56 becomes inoperative. When the first motor 4 is stopped as a consequence of the opening either of the manually-operated reversing switch 26 or of the automatic stop switch 27A, the circuit 51 for detecting the motor rotation delivers a logic signal denoting the elimination of the passage of current, so that on the one hand the energization of power members 60 and 61 is discontinued as a consequence of the locking of OR gates 58 and 59, so that brakes 6 and 16 become operative, and on the other hand the time-lag device 55 is actuated and delivers a logic signal of predetermined duration to the inputs of AND gates 56 and 57. Since gate 57 is rendered operative by the bistable circuit 54, the time-lag signal is supplied via gate 57 to the power member 63 and via gates 57 and 59 to power member 61, thus causing the energization of brake 16 and second motor 14 during the time period corresponding to the time-lag produced by device 55. Thus, the flexible web 1 is stretched. At the end of this time period, both power members 61 and 63 are off-circuit, thus locking the second brake 16 and the second motor 14. Thus, all the circuits are restored to their inoperative condition.

Inversely, when the reversing switch 26 is set to position II, the second motor 14 is energized and the flexible web 1 is rolled up. Therefore, the state of bistable circuit 54 is changed, whereby the AND gate 56 becomes operative and energizes the brake 6 and the first motor 4 during the time-lag period, after the motor 14 has been stopped as a consequence of the opening of reversing switch 26 or of the automatic stop switch 27B.

The driving device according to the present invention is particularly useful for driving screens, tents or canvasses for protection against rain and/or solar radiation, whenever such screens, tents or canvasses are not adapted to unroll in a substantially vertical plane, since in this case they cannot be stretched by a load bar. This applies notably to sunshade canvasses for skilights, glasshouses and the like.

What is claimed is:

1. Apparatus comprising a flexible protection element, a winding shaft for supporting the flexible protection element in the form of a roll, at least one winding drum, mounted in spaced-apart relation to the winding shaft, at least one flexible bond secured to a free end of the flexible protection element and also to the winding drum, a pair of electric motors, a pair of reversible reduction gears connecting the two motors respectively to the winding shaft and winding drum, one motor being adapted to rotate in one direction for rolling up said flexible bond on said winding drum and the other motor being adapted to rotate in one direction for rolling up said flexible element on said winding shaft, a pair of electromagnetic brakes of the type operating by current deficiency respectively operatively associated with the motors, and control means for energizing either one of said pair of electric motors and simultaneously energizing and thereby releasing both of said electromagnetic brakes.

2. Apparatus according to claim 1, wherein said electrical control means comprises an additional, manually operated switch for energizing one of said second motors with a reduced voltage and the brake operatively associated therewith, after deenergizing the other motor and brake.

3. Apparatus according to claim 1, wherein said electrical control means comprises an additional switch adapted to be actuated automatically for energizing one of said motors with a reduced voltage when the energization of the other motor and of the brake operatively associated therewith is discontinued.

4. Apparatus according to claim 1, wherein said control means comprises switch means adapted to energize either one of said two motors, means for detecting the energizing of said two motors, logic circuits responsive to said detecting means, and power members controlled by said logic circuits for energizing said two brakes.

5. Apparatus according to claim 4, wherein said control means comprises two logic circuits respectively responsive to the energizing of different ones of said motors, further comprising a bistable circuit and a time-lag device, said logic circuits cooperating with said bistable circuit and permitting, under the control of said time-lag device, with the interposition of said power members, one of them to control one of the motors and the other to control the brake operatively associated therewith.

* * * * *